United States Patent [19]

Tiso et al.

[11] 3,999,454

[45] Dec. 28, 1976

[54] PINLESS FEEDER

[75] Inventors: Albert Tiso, Eastchester; Robert Munn, Garnerville, both of N.Y.

[73] Assignee: George Hantscho Company, Inc., Mount Vernon, N.Y.

[22] Filed: Oct. 20, 1975

[21] Appl. No.: 623,574

[52] U.S. Cl. ..... 83/107; 83/110; 83/154; 270/21; 270/71; 271/82

[51] Int. Cl.[2] ..... B26D 7/06

[58] Field of Search ..... 270/70–72, 270/74–78, 21, 49, 50; 83/107, 110, 154; 271/80, 82, 277; 225/96, 96.5

[56] References Cited

UNITED STATES PATENTS

| | | | |
|---|---|---|---|
| 1,248,023 | 11/1917 | Seymour | 83/107 |
| 3,075,678 | 1/1963 | Huck | 270/78 |
| 3,521,512 | 7/1970 | Woessner | 270/21 |
| 3,897,051 | 7/1975 | Muller | 270/21 |

*Primary Examiner*—Clifford D. Crowder
*Attorney, Agent, or Firm*—Eugene E. Geoffrey, Jr.

[57] ABSTRACT

Pinless feeding apparatus for signatures wherein signatures from a printed web are automatically severed and fed to gripping cylinders having gripping fingers on the surface thereof. Positive engagement of each signature with a set of gripping fingers on the gripping cylinder is effected by modifying the rate of transport of each signature as it is severed and by controlling the transporting means so that each signature at any one time is primarily subjected to only one rate of transport.

9 Claims, 3 Drawing Figures

11
11'
27
28
29
30
31
32
33
38
39
44
45
50
62
63
69
70
71
72
73
74
75
76
77
78
79

PINLESS FEEDER

This invention relates to signature feeding apparatus for use with printing presses such as offset presses and the like and more specifically signature cutoff and feeding apparatus which does not require the use of pins for engaging each severed signature for the purpose of transporting it.

Prior known feeding apparatus for severed signatures have utilized a series of pins which perforate and engage the leading edge of each signature for the purpose of transporting it to folding or stacking stations. In that case, it is necessary before or after the folding or stacking operations, as the case may be, to trim the perforated edge of each signature which involves an additional operation. The utilization of pins also limits the speed of operation with the result that the press speed would also be limited. This invention overcomes the foregoing difficulties and provides a novel and improved apparatus for effecting the transport of severed signatures without the need for pins and thus avoids the need for an additional cutting operation and at the same time greatly increases the speed at which the signatures can be handled.

Another object of the invention resides in the provision of novel and improved apparatus having a plurality of fingers for gripping the leading edge of each severed signature for transport to successive stations for folding, stacking and the like.

Another object of the invention resides in the provision of novel and improved apparatus for gripping and holding the leading edges of signatures for the transportation thereof and at the same time alternate signatures may be fed through separate paths to enable a further increase speed of operation.

Still another object of the invention resides in the provision of novel and improved means for gripping and transporting severed signatures characterized by its simplicity, dependability and relatively high speed of operation.

The foregoing objects and advantages are attained through the use of gripping fingers carried by rollers and operated by cams to successively grip and release the leading edges of each signature and means for controlling the speed of transport of the signatures and movement of the gripping fingers to insure engagement of the signatures with the fingers and insure transport of the secured signature at a speed at least equal to the speed of the web.

The above and other objects and advantages will become more apparent from the following description and accompanying drawings forming part of this application.

Figure 1:
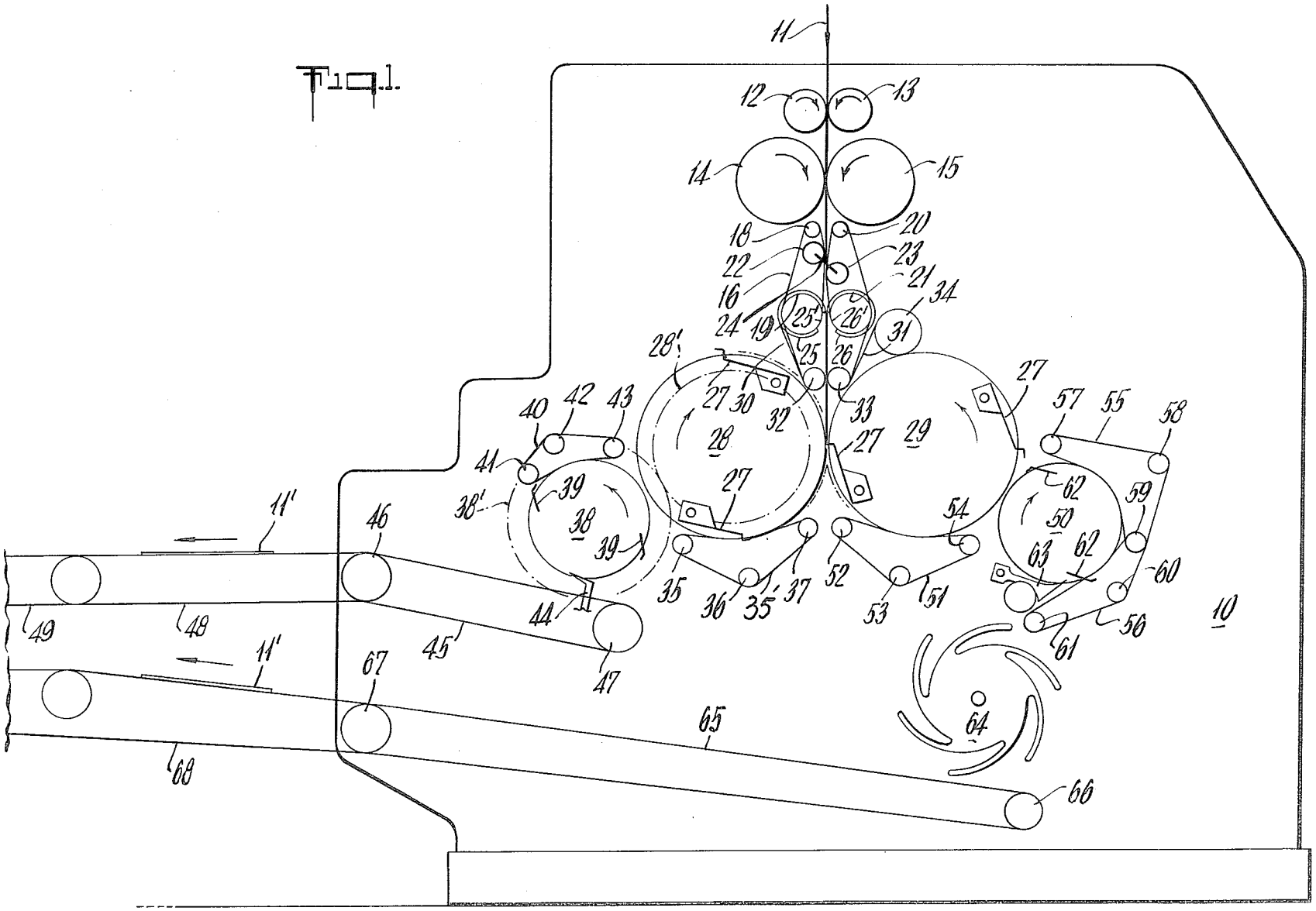
FIG. 1 is a side elevational view in partially diagrammatic form illustrating one embodiment of the invention.

Referring now to the drawings and more specifically to FIG. 1, the apparatus includes a pair of side frames of which only the frame 10 is illustrated and the rotating elements, such as feed rollers gripping devices, belt drives and the like are supported in the usual manner by the side frames.

The printed signature web 11 is fed downwardly between a pair of conventional air-nip rollers 12 and 13 preferably operating at a speed slightly greater than the speed of the printed web in order to maintain tension on the web. The web then passes between a pair of cutoff cylinders 14 and 15 also of conventional construction and arranged in the instant embodiment of the invention to sever two signatures during each rotation thereof. The diameter of these cylinders is of course coordinated with the length of the signatures and are arranged to cut the signatures to their finished lengths. As an example of the speed of operation, cylinders 14 and 15 may operate at surface speeds of about 1,000 feet per minute, though it will be obvious that the apparatus can be operated over a wide range of speeds above and below 1,000 feet per minute. It is of course important that the speed be precisely coordinated with the speed of the press which prints the web 11.

The leading signature on the web 11 just prior to severance is fed between two series of spaced belts 16 and 17 with the belts 16 carried by sets of rollers 18 and 19 and the belts 17 carried by 20 and 21. Sets of rollers 22 and 23 are carried by arms 24 pivoted to the frames 10 centrally of their lengths control the nip pressure between belts 16 and 17 which operate at the speed of the cutoff cylinders 14 and 15 which as pointed out above would be the web speed. Following the belts 16 and 17 are two series of timed, segmented signature pickup cylinders 25 and 26, each of which have short segments of the surface removed. These pickup cylinders are driven at a speed slightly greater than the speed of the belts 16 and 17 and are approximately one half the diameter of the cutoff cylinders 14 and 15. As each signature is severed, it is picked up by the belts 16 and 17 and as the leading edge approaches the nip of the segmented cylinders 25 and 26, the latter increases the speed of transport of the signature to move it into engagement with the gripping fingers 27 on one or the other of the gripper cylinders 28 and 29. At the moment a signature is gripped by one set of fingers 27, the trailing edge is released because of the presence of the removed surface portion 25′ and 26′ on cylinders 25 and 26. The sets of belts 30 and 31 interposed between the belts 16 and 17 and the cylinders 25 and 26 merely guide the signatures to the gripper cylinders 28 and 29 and are carried by lower rollers 32 and 33 and upper rollers (not shown) concentric with and of equal diameter to the segmented cylinders 25 and 26. The belts 30 and 31 preferably have the same surface speed as cylinders 25 and 26. A register gear 34 shown diagrammatically, coordinates the operation of the segmented cylinders 25 and 26 with the gripper cylinders 28 and 29. The other cylinders, belts and rollers are of course driven in the conventional manner to achieve the mode of operation described above.

As pointed out above, the severed signatures 11′ alternately engage fingers on the cylinders 28 and 29. The gripping cylinder 28 rotates clockwise, and as the first signature leaves the nip between cylinders 28 and 29, it is held against the cylinder 28 by a series of belts 35 carried by sets of rollers 35, 36, and 37. As the leading edge of the signature approaches the nip between gripping cylinder 28 and its cooperating gripping cylinder 38, the fingers 27 are actuated to release the signature and the cylinder 28 and belts 35′ drive it into engagement with one set of fingers 39 on the cylinder 38. In order to effect positive engagement of the signature with the fingers 39, the surface speed of the cylinder 38 is maintained slightly below the surface speed of the cylinder 28, but in angular synchronism therewith. This is effected by making cylinder 38 smaller diameter than cylinder 28 and coupling them with gears 28′ and 38′ (shown in broken lines) having equal numbers of teeth. The signature in engagement with one set of fingers 39 on cylinder 38 is then carried beneath a series of belts 40 carried by sets of rollers 41, 42, and 43. As the leading edge of the signature approaches the stripper 44 which also functions as a stop, the signature is deposited on the conveyor belt 45 carried by rollers 46 and 47 and is transported by successive belts 48 and 49 as may be desired.

Alternate signatures are fed in about the gripping cylinders 29 and 50 in the same manner as described in connection with gripping cylinders 28 and 38. It will be observed that cylinder 29 includes a cooperating set of belts 51 carried by rollers 52, 53, and 54 while the gripping cylinder 50 has two sets of cooperating belts 55 and 56 carried by rollers 57 through 61. As a signature is fed about the cylinder 50, the set grippers 62 carrying the leading edge is released and the signature is stripped by strippers 63 and fed downwardly to the fan 64 which deposits them on a conveyor 65 carried by rollers 66 and 67 for transport to a successive conveyor belt 68, if desired.

Figures 2, 3:
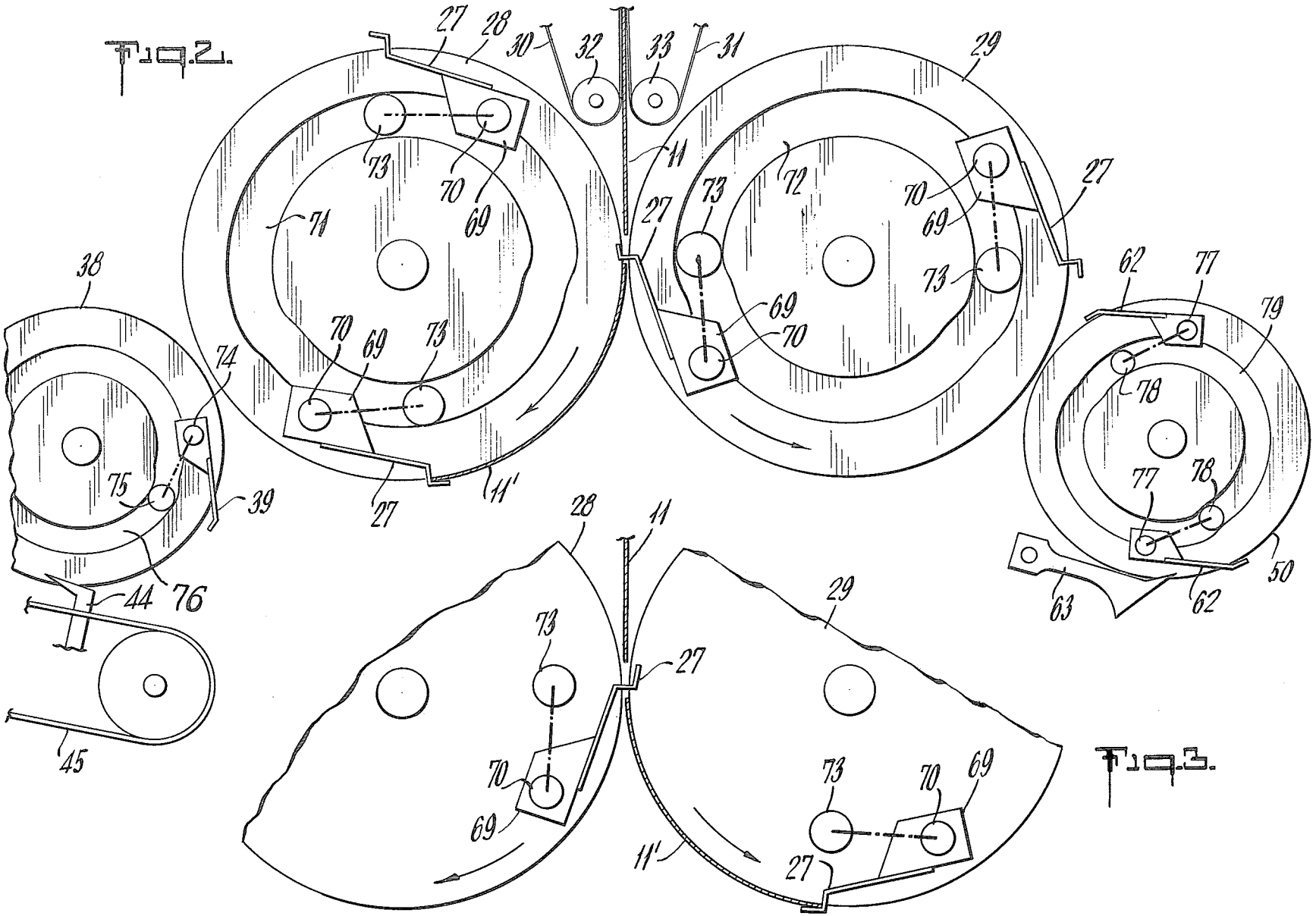
FIG. 2 is an enlarged view of a fragmentary portion of FIG. 1 illustrating the mechanism for operating the gripping fingers to grip the leading edge of a signature.
FIG. 3 is a fragmentary view of FIG. 2 illustrating the mechanism to grip the next successive signature so that alternate signatures are fed into separate paths.

FIGS. 2 and 3 illustrate in greater detail the operation of the invention to effect engagement of the signatures by the gripper cylinders. The gripper fingers 27 of cylinders 28 and 29 are each carried by a support 69 and the supports 69 of each set of fingers are fixed to a common shaft 70 so that each set of fingers can be moved simultaneously between gripping and releasing positions. Operation of the fingers is effected by cam 71 associated with cylinder 28 and cam 73 associated with cylinder 29. Cam followers 73 and cam 72 are each mechanically coupled to one of the finger control shafts 70, and since the cam 71 is fixed relative to the frame of the machine, the fingers will be automatically moved between the two positions. The gripper cylinder 29 is similarly arranged except that it rotates in a counter clockwise direction. The cooperating gripper cylinders 38 and 50 are arranged in the same manner as cylinders 28 and 29. For instance, each set of fingers 39 with the associated supports on cylinder 38 is carried by a shaft 74 which is mechanically coupled to a cam follower 75 riding in cam 76. Similarly, each set of fingers 62 and associated supports on gripper cylinder 50 is carried by a shaft 77 which is mechanically coupled to a cam follower 78 riding in cam 79.

In the operation of the apparatus in accordance with the invention, the signatures must be severed from the web 11 at the web speed and thereafter the speed of the individual signatures 11′ must be varied in order to effect positive engagement with the gripping cylinders 28 and 29 and then with the gripping cylinders 38 and 50. This is attained through the utilization of the segmented cylinders 25 and 26, each of which has a portion of the periphery 25′ and 26′ removed to facilitate release of a signature when a leading edge is in engagement with one of the two gripping cylinders 28 and 29. To effect this end the belts 16 and 17 which are principally for guidance have a surface speed equivalent to the surface speed of the cut off cylinders and a given signature does not engage the segmented cylinders 25 and 26 until after it has been severed. The cylinders 25 and 26 together with the belts 30 and 31 drive each signature at a somewhat greater rate of speed than the web speed and also at a greater speed than the surface speed of the cylinders 28 and 29. The surface speed of the cylinders 28 and 29 is greater than the web speed but less than cylinders 25 and 26. As an example, with a web speed of 1,000 feet per minute, the cylinders 28 and 29 may operate at approximately 9 percent over speed while the cylinders 25 and 26 together with belts 30 and 31 operate at about 13 percent over speed. With this arrangement each signature is driven firmly into engagement with a set of fingers on either the cylinder 28 or the cylinder 29 as the case may be, and when the leading edge of the signature is firmly gripped, the segmented portions 25′ and 26′ of cylinders 25 and 26 release the trailing edge. Since the belts 30 and 31 act principally as guides rather than for the purpose of driving the signature, the signature will move downwardly at the speed of its gripping cylinder. With this arrangement, signatures can be handled easily at the speed of the web and at the same time the leading edges can be firmly gripped by sets of fingers on the cylinders 28 and 29.

Referring now specifically to FIGS. 2 and 3, it will be noted that one signature 11′ has been engaged by the lower set of fingers 27 on cylinder 28 which carry it about the bottom of the cylinder where it is engaged by belts 35′ (FIG. 1). As the fingers 27 approach the centerline of cylinders 28 and 38, they are moved to the release position. At the same time, fingers 39 of cylinder 38 are in the release position, but since the peripheral speed of cylinder 28 and belts 34 is greater than the peripheral speed of cylinder 38, the leading edge of the signature is fed beneath the fingers 39. Fingers 39 immediately close and carry the signature about the cylinder and then release it just prior to the engagement of the signature by the stripper and stop 44. The signature then falls upon the conveyor belt 45.

In the meantime, the next successive signature has been engaged by a set of fingers 27 on cylinder 29 and is transferred to cylinder 50 in the same manner described in connection with cylinders 28 and 38 and then, through the use of the fan 64, deposited on conveyor 65. The fan is merely for the purpose of inverting the signatures on conveyor 65 so that they will have the same relative positions as the signatures deposited on conveyor 45.

While only one embodiment of the invention has been illustrated and described, it is understood that alterations, modifications and changes may be made without departing from the true scope and spirit thereof.

What is claimed is:

1. A pinless signature feeder comprising cutting rollers for completely severing signatures from a continuously moving web and at the web speed, uniformly rotating means for engaging each signature after complete severance and continuously advancing it at a surface speed greater than the web speed, at least one gripper cylinder having at least one set of gripper fingers and camming means for moving said fingers to gripping and release positions, said gripper cylinder having a continuous surface speed at least equal to the web speed and slightly less than the surface speed of said engaging means, said engaging means terminating its transport of the signature upon engagement of the signature with said gripper fingers, said camming means moving said fingers to the gripping position upon receipt of a signature and then to the release position to discharge the signature in preparation for receipt of the next signature.

2. A pinless signature feeder according to claim 1 wherein the surface speed of said gripper cylinder exceeds the web speed.

3. A pinless signature feeder according to claim 1 wherein said engaging means comprises a pair of driving cylinders each having at least one segmental portion of the surface recessed throughout the axial length thereof, the peripheral length of each cylinder being at least equal to the length of a signature whereby said driving cylinders will move a signature into engagement with said fingers whereupon said recessed segmental portions effect a termination of the signature transport and permit it to be moved under the influence of said gripper cylinder.

4. A pinless signature feeder according to claim 3 including a pair of gripper cylinders each having at least one set of gripper fingers, said gripper cylinders being phased to receive and grip alternate signatures.

5. A pinless signature feeder according to claim 4 wherein each of said gripper cylinders has two sets of gripper fingers.

6. A pinless signature feeder according to claim 3 wherein said severing means comprises a pair of cooperating cylinders having at least one cutting element on one cylinder and a cooperating element on the other cylinder for severing said signatures, said feeder further including a second pair of cooperating belts disposed between said cutting cylinders and said driving cylinders, said belts having a surface speed substantially equal to the surface speed of the cutting cylinders for guiding signatures from said cutting cylinders to said driving cylinders, and a second pair of cooperating belts between said driving cylinders and said gripper cylinder and operating at a surface speed approximately equal to the surface speed of the driving cylinders for guiding signatures to said gripper cylinders.

7. A pinless signature feeder according to claim 6 including a pair of gripper cylinders each having at least one set of gripper fingers, said gripper cylinders being phased to receive and grip alternate signatures.

8. A pinless signature feeder according to claim 7 wherein each of said gripper cylinders has two sets of gripper fingers.

9. A pinless signature feeder according to claim 7 including a second gripper cylinder associated with each of said pair of gripper cylinders, each of said second gripper cylinders having at least one set of gripper fingers and camming means for the operation thereof, said second gripper cylinders each having a surface speed slightly less than the surface speed of the first said gripper cylinders whereby each signature carried by one of the first said gripper cylinders is released and then moved into engagement with the gripper fingers of the associated second gripper cylinder for transfer to said second gripper cylinder.

* * * * *